US006299372B1

(12) United States Patent
Wang

(10) Patent No.: US 6,299,372 B1
(45) Date of Patent: Oct. 9, 2001

(54) ADVERTISE EFFECT PHOTO PEN

(76) Inventor: Kuan Yun Wang, No. 3, Lane 414, Sec. 2, An Kang Rd., Hsintien City, Taipei Hsien (TW)

( * ) Notice: Subject to any disclaimer, the term of this patent is extended or adjusted under 35 U.S.C. 154(b) by 0 days.

(21) Appl. No.: 09/710,856

(22) Filed: Nov. 14, 2000

(51) Int. Cl.[7] ..... B43K 29/007; B43K 29/10

(52) U.S. Cl. ..... 401/195; 401/52; 40/334; 40/905; 362/118

(58) Field of Search ..... 401/195, 52; 362/118; 40/334, 905; 15/435

(56) References Cited

U.S. PATENT DOCUMENTS 5,673,996 * 10/1997 Ducker ..... 362/118
6,164,856 * 12/2000 Lo ..... 401/52

* cited by examiner

*Primary Examiner*—Gregory L. Huson
*Assistant Examiner*—Kathleen J. Prunner
(74) *Attorney, Agent, or Firm*—Rosenberg, Klein & Lee

(57) ABSTRACT

An advertise effect photo pen includes a front tube, a connecting seat and a rear tube. The rear end of the front tube is installed with an outer thread, in assembling, the outer thread is screwed into an inner thread of the connecting tube. The rear end of the connecting seat is installed with an outer thread, in assembling, the rear end of the connecting seat is screwed into an inner thread of the rear tube. Therefore, the rear tube is connected to the front tube by the connecting seat. The front tube is a hollow transparent material and a refill is connected at a front end. The surface of the connecting seat is a hollow transparent material. After processed by web printing, the surface is formed with a transparent surface and a shielding surface; and the shielding surface or the transparent surface has advertise patterns. The light emitting unit is a single color or a multiple color element. When the user touches a light emitting unit, the transparent surface and the surface of the front tube will light up to present an advertise effect.

18 Claims, 7 Drawing Sheets

ADVERTISE EFFECT PHOTO PEN

FIELD OF THE INVENTION

The present invention relates to an advertise effect photo pen, and especially to a photo pen with a connecting tube the surface of which is etched by web printing so as to be formed with a transparent surface and a shielding surface. The transparent surface has advertise patterns. When the user touches a light emitting unit, the transparent surface and the surface of the front tube will light up to present an advertise effect.

BACKGROUND OF THE INVENTION

FIGS. 1 and 2 illustrates a prior art photo pen which includes a pen body 1*a,* a seat 2*a,* a battery 3*a,* a push 4*a* and a cover 5*a*. The upper end of the pen body 1*a* is installed with a seat 2*a*. The top and bottom of the seat 2*a* are installed with a conductive pin 21*a* and a light emitting unit 22*a*. A battery 3*a* is installed on the conductive pin 21*a*. The battery 3*a* is installed with a push 4*a*. The push 4*a* has a spacer 41*a* with a through hole 411*a* at the center thereof so as to resist against the battery 3*a*. The upper side of the spacer 41*a* resists against a positioning plate 43*a* through a spring 42*a*. The bottom of the positioning plate 43*a* extrudes with a rod 431*a*. The periphery of the rod 431*a* has a conductive reed 44*a* extending to the through hole 411*a* of the spacer 41*a*. A movable block 45*a,* a press block 46*a* and a cap 47*a* are sequentially installed from the positioning plate 43*a*. A cover 5*a* covers on the battery 3*a* and the push 4*a* so that the spacer 41*a* of the push 4*a* is fixed to the inner wall of the cover 5*a*. At the connection of the seat 2*a* and the cover 5*a* is disposed with a ring 6*a*. However, in this prior art photo pen, the light from the light emitting unit 22*a* is only dispersed from the tip 7*a*. The surface of the pen body 1*a* will not emit light. Therefore, an advertising effect can not be present. The photo pen serves to increase the distance between the conductive reed 44*a* of the push 4*a* and the battery 3*a*. When the cap 47*a* of the photo pen is pushed to a dead point, the light emitting unit 22*a* lights up. And thus the operation is very inconvenient.

SUMMARY OF THE INVENTION

Accordingly, the primary object of the present invention is to provide an advertise effect photo pen, wherein after processed by web printing, the surface is formed with a transparent surface and a shielding surface; and the shielding surface or the transparent surface having an advertise pattern. The light emitting unit is a single color or a multiple color element. When the user touches a light emitting unit, the transparent surface and the surface of the front tube will light up to present an advertise effect. A trigger switch is installed on the tube surface, the user is only necessary to press the switch slightly, then, the light emitting element will be enabled so that the photo pen will light up.

To achieve the objects, the present invention provides an advertise effect photo pen including a front tube, a connecting seat and a rear tube. Therefore, the rear tube is connected to the front tube by the connecting seat. The front tube is a hollow transparent material and a refill 4 is connected at a front end. The surface of the connecting seat is a hollow transparent material. The shielding surface or the transparent surface have an advertise pattern. The rear tube is installed with a light emitting unit. The light emitting unit includes a circuit board, a key switch, a light emitting element, and a battery; the circuit board is connected to the key switch, light emitting element, and a spring, and the spring is connected to the battery.

The various objects and advantages of the present invention will be more readily understood from the following detailed description when read in conjunction with the appended drawing.

DETAILED DESCRIPTION OF THE PREFERRED EMBODIMENTS

Figure 1:
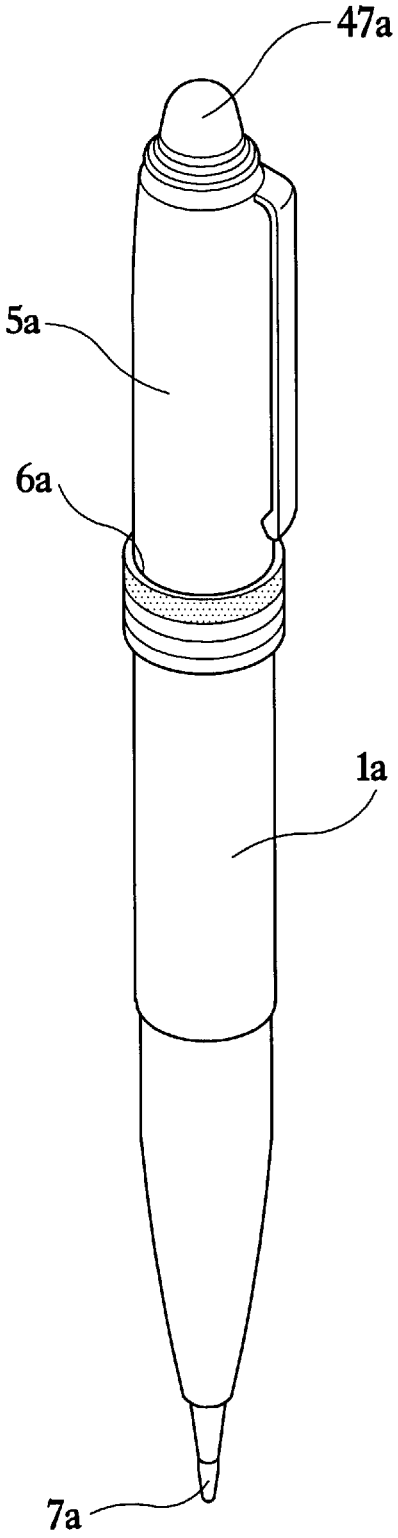
FIG.1 PRIOR ART
FIG. 1 is a perspective view of a prior art photo pen.
Figure 2:
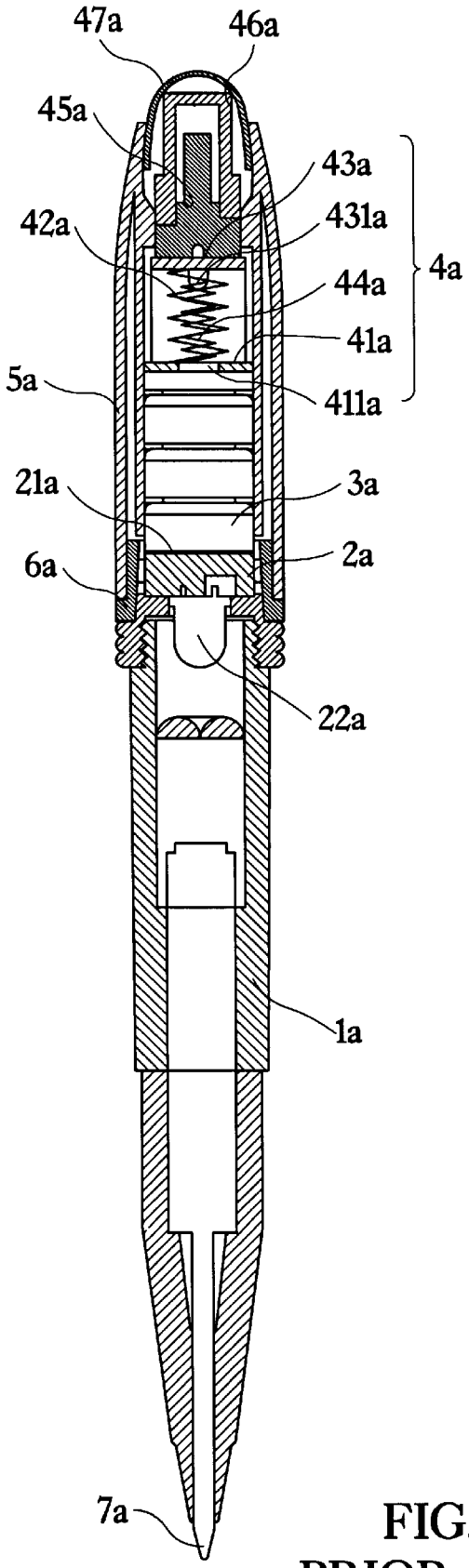
FIG.2 PRIOR ART
FIG. 2 is an exploded perspective view of a prior art photo pen.
Figure 3:
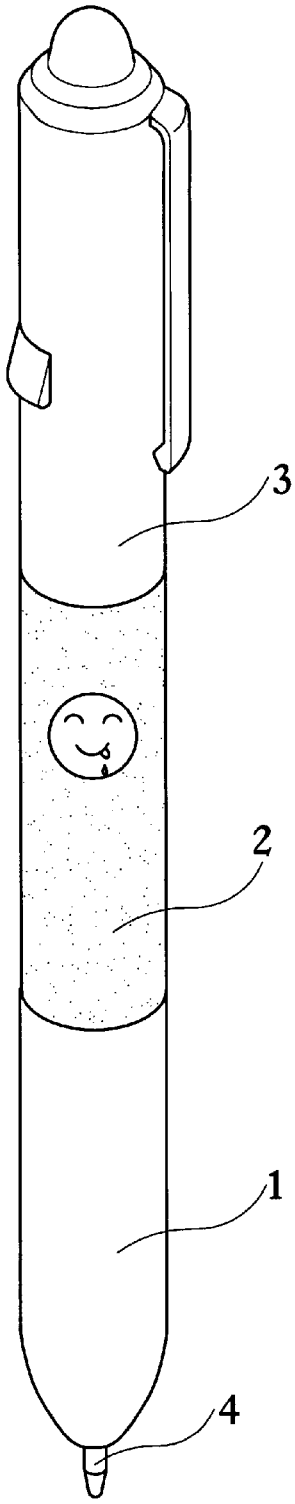
FIG. 3 is a perspective view of the present invention.
Figure 4:
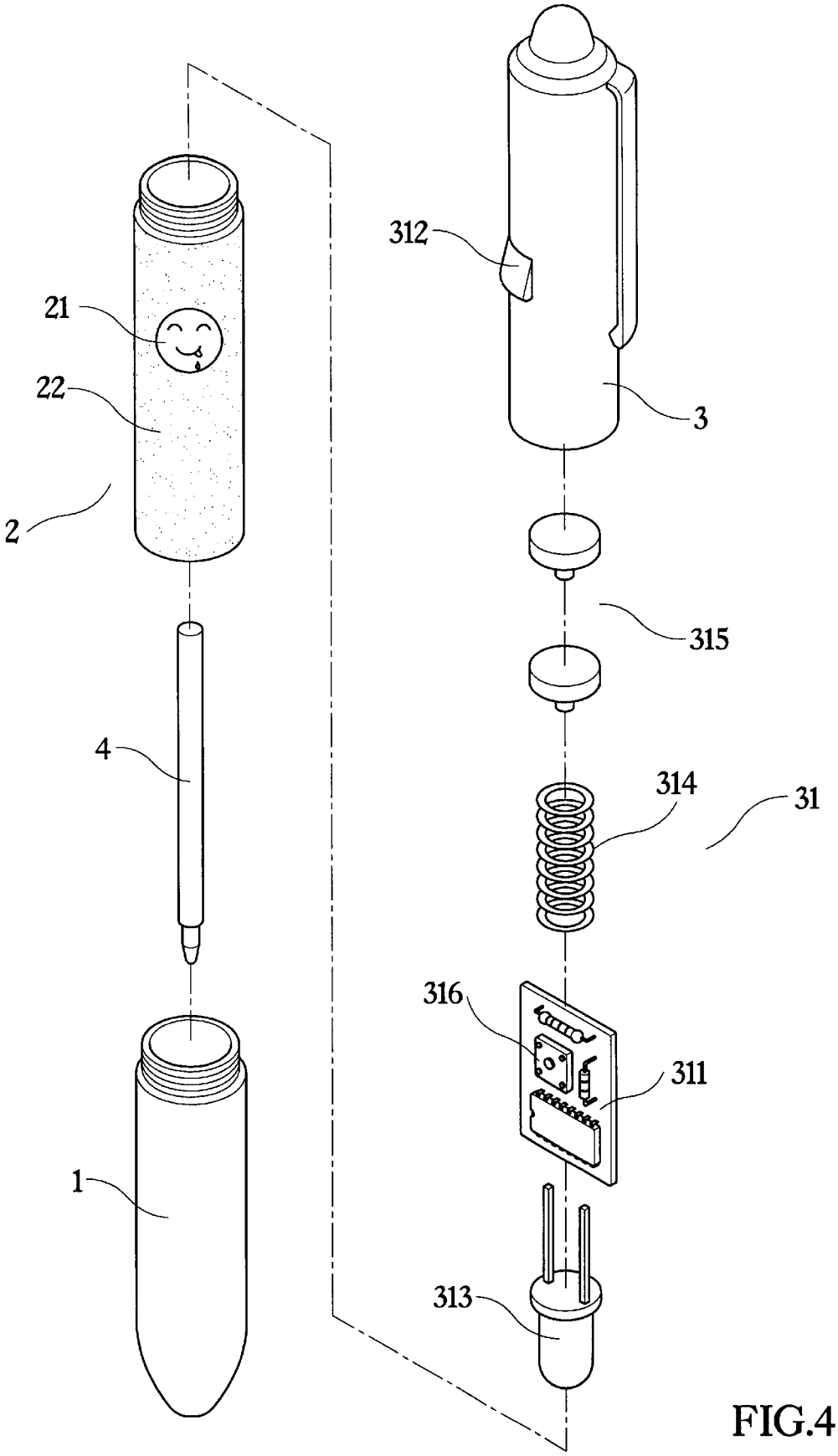
FIG. 4 is an exploded perspective view of the present invention.

Referring to FIGS. 3 and 4, an advertise effect photo pen of the present invention is illustrated. The advertise effect photo pen has a front tube 1, a connecting tube 2, and a rear tube 3. The front tube 1 has a rear end for being installed with an outer thread. In assembly, the rear end of the front tube 1 is screwed into the inner thread of the connecting tube 2. The rear end of the connecting tube 2 may be formed with an outer thread so that the rear tube 3 is connected to the front tube 1 thereby. The front tube 1 is a hollow material for writing. The tube surface of the connecting tube 2 is a hollow transparent material, which is etched by web printing technology but a part thereof is remained not to be etched.

Figure 5:
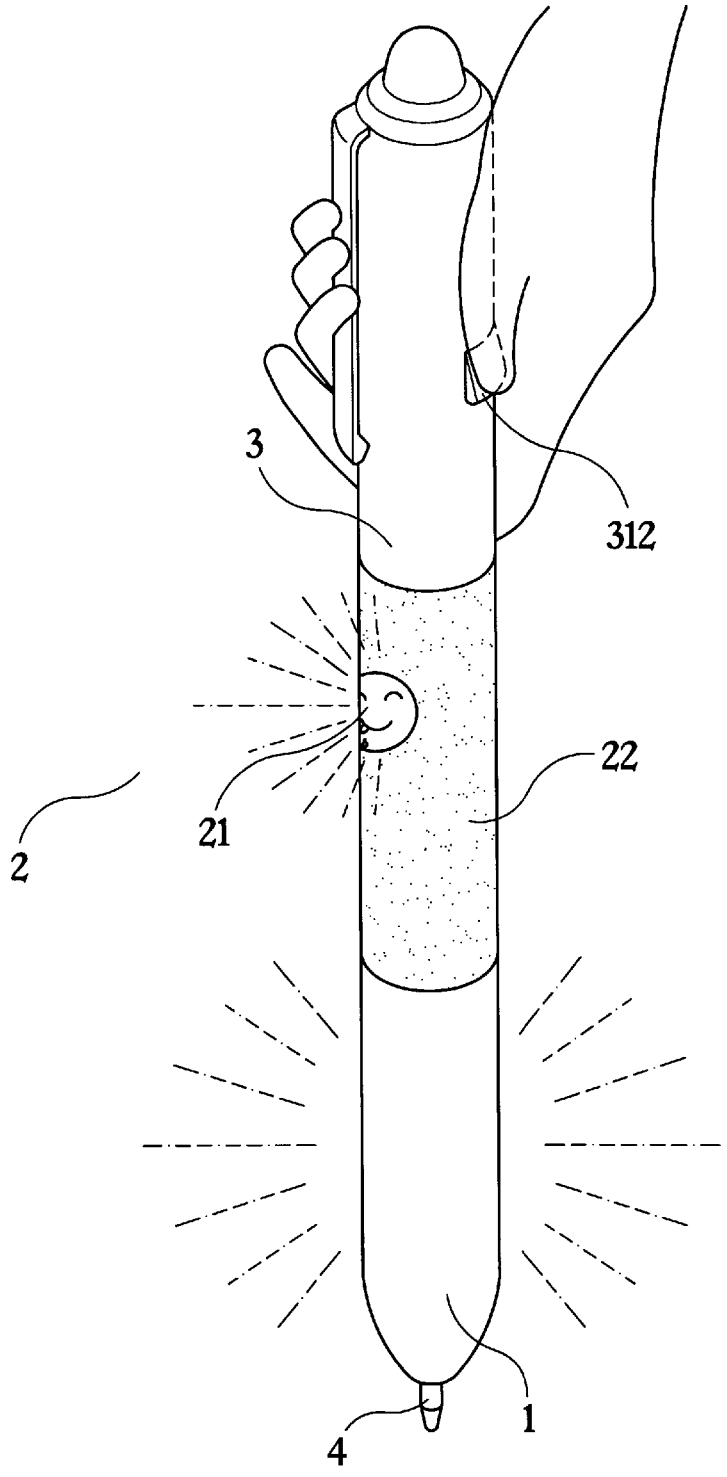
FIG. 5 is an embodiment of the present invention.

Thus, it is presented with a transparent surface 21 and a shielding surface 22. The transparent surface 21 is the area not to be etched. The transparent surface 21 is designed with an advertise pattern. The shielding surface 22 is etched by chemical agents and thus has a coarse surface. The rear tube 3 is installed with a light emitting unit 31. The light emitting unit 31 includes a circuit board 311, a key 312, a light emitting diode 313, a spring 314, and a battery 315. The circuit board 311 is installed with a key switch 316 and a plurality of circuit elements. The circuit board 311 is connected to the light emitting diode 313 and the spring 315. The spring 314 is connected to the battery 315. The key 312 protrudes from the tube surface of the rear tube 3. The light emitting diode 313 may be a general single color light emitting diode 313 or chromatic light emitting diodes 313. As enabling, the chromatic light emitting diode 313 will present colors of red, green and blue. Furthermore, the circuit board 311 and the battery 315 are open-circuited. When the user touches the key 312 (as shown in FIG. 5), the key 312 is pushed to the tube surface to press the key switch 316 of the circuit board 311 so as to be conducted. Thus, the circuit board 311 will enable the light emitting diode 313. If the user's hand releases from the key, the key 312 will return to the original place, then the circuit board 311 and the battery 315 will return to the original condition.

Figure 6:
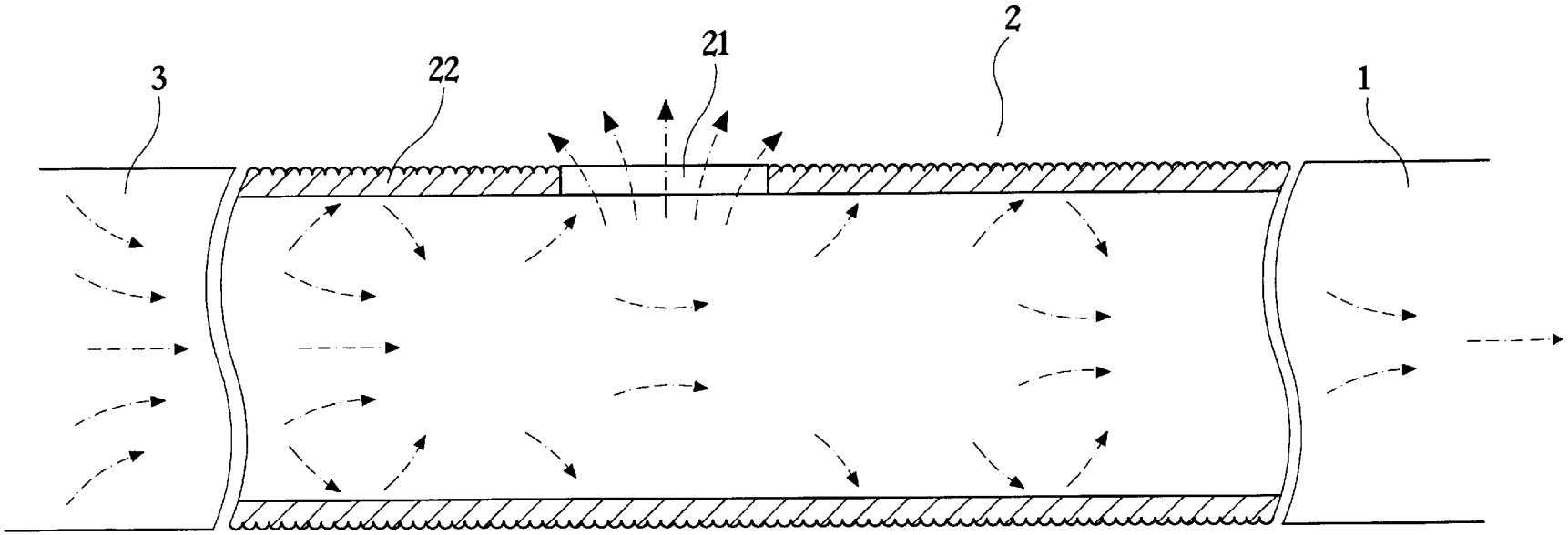
FIG. 6 shows the light path in the connecting tube of the present invention.

Referring to FIG. 6, the light source of the light emitting diode 313 (referring to FIG. 4) passes through the connecting tube 2, the shielding surface 22 will be etched to cause a coarse surface and therefore, the light transmitting to the shielding surface 22 will not disperse to be out of the connecting tube 2, thus it can be reflected and the loss is low. The light to the transparent surface 21 and front tube 1 will emit out, and further, the transparent surface 21 is formed with an advertise pattern which can be seen by the illumination of the light so as to achieve the object of advertise.

Figure 7:
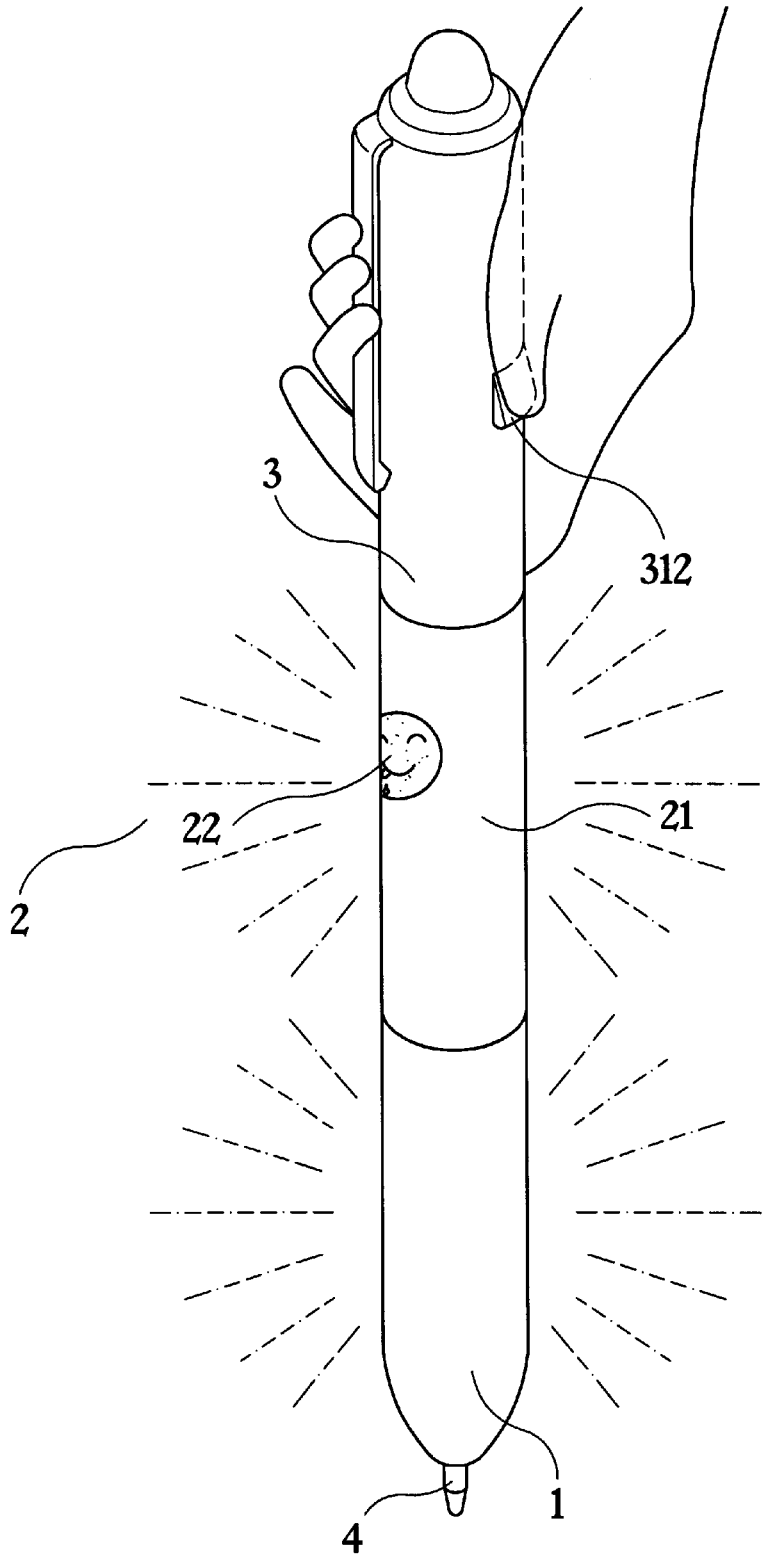
FIG. 7 is an embodiment of the present invention.

Referring to FIG. 7, the second embodiment of the present invention is illustrated. The shielding surface 22 may be designed with an advertise pattern. Then the light source passes through the connecting tube 2, since the shielding surface 22 is etched to have a coarse surface, the light to the shielding surface 22 will not be dispersed to be out of the connecting tube 2, and is therefore reflected and thus, it has a lower loss. The light to the transparent surface 21 and the front tube 1 will emit out so as to present the advertise effect to achieve an advertise effect.

Therefore, the advertise effect photo pen has the following advantages:

1. After the key of the phone pen is pressed, the circuit board will conduct to enable a light emitting element.
2. When the user touches an light emitting unit, the transparent surface and the surface of the front tube will light up to present an advertise effect.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An advertise effect photo pen comprising:

a front tube;

a connecting tube assembled to a rear end of the front tube, a surface of the connecting tube being made of a hollow transparent material; after processed by web printing, the surface being formed with a transparent surface and a shielding surface; and the shielding surface having an advertise pattern; and a rear tube assembled to a rear end of the connecting tube for being connected to the front tube; and a light emitting unit being installed in the rear tube.

2. The advertise effect photo pen as claimed in claim 1, wherein the front tube is a hollow transparent material; and receives a refill at a front end thereof.

3. The advertise effect photo pen as claimed in claim 2, wherein the refill is a refill of a ball pen or a fountain pen for writing.

4. The advertise effect photo pen as claimed in claim 1, wherein the rear end of the front tube is installed with an outer thread, in assembling, the outer thread is screwed into an inner thread of the connecting tube.

5. The advertise effect photo pen as claimed in claim 1, wherein the rear end of the connecting tube is installed with an outer thread, in assembling, the rear end of the connecting tube is screwed into an inner thread of the rear tube.

6. The advertise effect photo pen as claimed in claim 1, wherein the light emitting unit includes a circuit board, a key switch, a light emitting element, and a battery; the circuit board is connected to the key switch, light emitting element, and a spring, and the spring is connected to the battery.

7. The advertise effect photo pen as claimed in claim 6, wherein the light emitting element is a light emitting diode or a bulb.

8. The advertise effect photo pen as claimed in claim 6, wherein the light emitting element is a single color element.

9. The advertise effect photo pen as claimed in claim 6, wherein the light emitting element is varied to present various colors.

10. An advertise effect photo pen comprising:

a front tube;

a connecting tube assembled to a rear end of the front tube, a surface of the connecting tube being made of a hollow transparent material; after processed by web printing, the surface being formed with a transparent surface and a shielding surface; and the transparent surface having an advertise pattern; and a rear tube assembled to a rear end of the connecting tube for being connected to the front tube, and a light emitting unit being installed in the rear tube.

11. The advertise effect photo pen as claimed in claim 10, wherein the front tube is a hollow transparent material; and receives a refill at a front end thereof.

12. The advertise effect photo pen as claimed in claim 11, wherein the refill is a refill of a ball pen or a fountain pen for writing.

13. The advertise effect photo pen as claimed in claim 10, wherein the rear end of the front tube is installed with an outer thread, in assembling, the rear end of the front tube is screwed into an inner thread of the connecting tube.

14. The advertise effect photo pen as claimed in claim 10, wherein the rear end of the connecting tube is installed with a outer thread, in assembling, the rear end of the connecting tube is screwed into an inner thread of the rear tube.

15. The advertise effect photo pen as claimed in claim 10, wherein the light emitting unit includes a circuit board, a key switch, a light emitting element, and a battery; the circuit board is connected to the key switch, light emitting element, and a spring, and the spring is connected to the battery.

16. The advertise effect photo pen as claimed in claim 15, wherein the light emitting element is a light emitting diode or a bulb.

17. The advertise effect photo pen as claimed in claim 15, wherein the light emitting element is a single color element.

18. The advertise effect photo pen as claimed in claim 15, wherein the light emitting element is varied to present various colors.

* * * * *